United States Patent [19]

Seidel

[11] 4,241,963

[45] Dec. 30, 1980

[54] METHOD AND APPARATUS FOR UTILIZING VOID SPACES IN CABINETS AND THE LIKE

[76] Inventor: Charles Seidel, 436 Girard, Royal Oak, Mich. 48067

[21] Appl. No.: 36,392

[22] Filed: May 7, 1979

[51] Int. Cl.[3] ..... A47B 88/00; A47F 7/08

[52] U.S. Cl. ..... 312/228; 312/207; 312/246; 312/313

[58] Field of Search ..... 312/206, 207, 228, 229, 312/242, 246, 302, 307, 311, 313; 108/32, 34, 35

[56] References Cited

U.S. PATENT DOCUMENTS

| | | | |
|---|---|---|---|
| 2,657,967 | 11/1953 | Gilchrist | 312/246 |
| 2,796,310 | 6/1957 | Anderson | 312/246 |
| 3,292,983 | 12/1966 | Service | 312/228 |
| 4,168,871 | 9/1979 | Dierkes | 312/313 |

*Primary Examiner*—Casmir A. Nunberg
*Attorney, Agent, or Firm*—Dolgorukov & Dolgorukov

[57] ABSTRACT

The specification discloses a novel method and apparatus for utilizing the void spaces previously present in kitchen cabinets, bathroom vanities and the like. The solid front panel normally present in front of the depression serving as the bathroom or kitchen sink is hingedly mounted to swing forwardly and outwardly for an angle of at least 90°. To this panel there is mounted a shelf having a forward portion hingedly mounted to the panel adapted to swing forwardly and outwardly, and a rear portion complimentary in shape to the space available under the vanity. The shelf has perpendicular sides and thus there is formed substantially a rectangular shelf with a cutaway complimentary in shape to the sink being utilized. The rear of the shelf is provided with a pin assembly which rides on a pair of rails mounted on the inside side walls of the cabinet at an angle, preferably 22½°, so that as the front panel is swung open, the shelf will move outwardly and downwardly into a usable position while maintaining its horizontal planar position.

17 Claims, 10 Drawing Figures

METHOD AND APPARATUS FOR UTILIZING VOID SPACES IN CABINETS AND THE LIKE

The present invention deals with a method and apparatus for utilizing void spaces presently found in cabinets, housings, bathroom and kitchen sinks and the like. For a long period of time it has now been the practice in stylish homes to replace the old free standing bathroom sink with a sink and storage cabinet arrangement commonly called a "bathroom vanity". The bathroom vanity consists of a substantially square or rectangular cabinet base having a marble, formica, or other type counter top provided, into which is set or formed a sink bowl which extends downwardly from the top surface of said counter top.

It has been the practice that since the portion of the vanity in front of the sink was virtually unusable, it would just be closed by a blank panel, and to utilize the usable space in the vanity, doors would be provided whose upper extremity did not come past the bottom of the sink. These doors could then be opened to expose a storage space below the sink depression, usually consisting of one or two shelves.

Since it is well known in the art that it would be desirable that the otherwise wasted space in front of the sink be utilized, there has been a long standing search for ways to do just that.

One of the solutions that I am familiar with is to put two very small drawers at either end of the vanity which could extend past the side of the sink bowl, and to use a smaller front panel. However, this is practical only in vanities larger than 30 or 36 inches, and does not solve the problem in the small vanities which are today finding wide acceptance. Indeed, even though the provision of the two small drawers does provide additional storage space in the larger vanities, this still does not solve the problem of how to use the space directly in front of the sink bowl, and this remains a problem in the art.

One of the hardest problems to solve, and one that has remained unsolved until the present time, is how to provide a useful storage space once it is provided for the small front panel to open in any manner. Just providing for the opening of the front panel does not in itself provide the storage space, and the providing of any sort of stationary shelf is impractical because of the nature of the opening provided which is very narrow and difficult to see or reach into, thus making any stationary shelf undesirable. Thus, it became obvious to me that one had to provide a shelf in the space provided which would move out from the vanity itself when the small panel was open.

Thus, one of the objects of the present invention is to provide a method and apparatus for utilizing the void spaces in bathroom vanities, kitchen sinks and the like wherein a movable shelf is provided.

A further object of the present invention is to provide a shelf of the above nature which is activated by the movement of a swing down panel on the front of said vanity.

A still further object of the present invention is to provide an apparatus for utilizing the void spaces in the front of bathroom vanities and the like which includes a rectangular movable shelf having a rear portion complimentary in shape to the space available in front of the sink in said vanity.

A still further object of the present invention is to provide a method and apparatus for utilizing the void spaces in front of bathroom vanities, kitchen sinks and the like which is usable regardless of the size of said sink, vanity or the like.

A still further object of the present invention is to provide a method and apparatus for utilizing the void spaces in vanities or the like which utilizes a hinged shelf adapted to move forwardly and outwardly while remaining in a horizontal plane by using a pin and slot assembly provided at an angle of approximately $22\frac{1}{2}°$.

Another object of the present invention is to provide a shelf of the foregoing nature with a suitable opening for the storage of toothbrushes and the like.

A still further object of the present invention is to provide a shelf of the foregoing nature which remains in a substantially horizontal plane throughout its entire movement.

Another object of the present invention is to provide a shelf of the foregoing nature having suitable depressions therein for holding a bar of soap and the like.

A still further object of the present invention is to provide a method and apparatus for utilizing the void spaces in vanities and the like which is relatively simple and inexpensive to manufacture.

Further objects and advantages of the present invention will be apparent from the following description and appended claims, reference being made to the accompanying drawings forming a part of the specification, wherein like reference characters designate corresponding parts in the several views.

It is to be understood that the invention is not limited in its application to the details of construction and arrangement of parts illustrated in the accompanying drawings, since the invention is capable of other embodiments and of being practiced or carried out in various ways within the scope of the claims. Also, it is to be understood that the phraseology and terminology employed herein is for the purpose of description and not of limitation.

Figure 1:
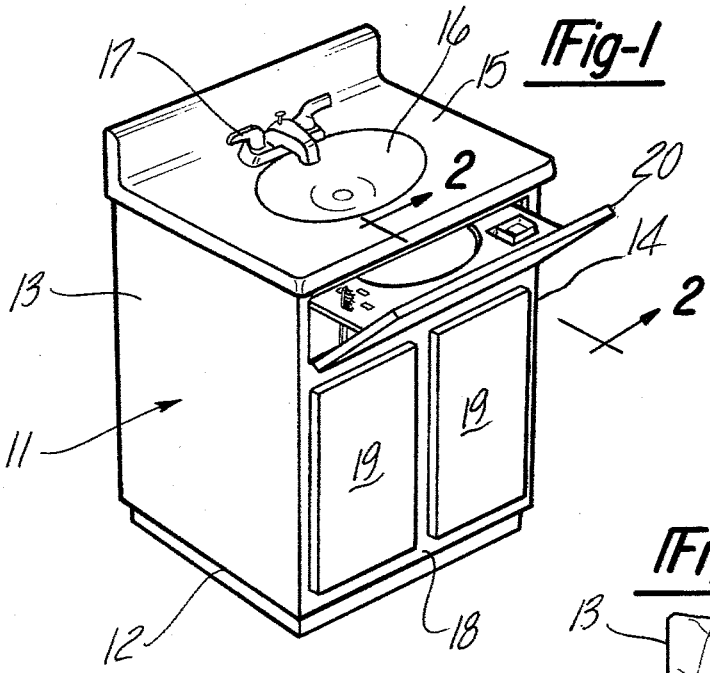
FIG. 1 is a perspective view of a construction embodying my invention.
Figure 3:
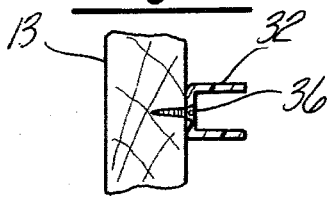
FIG. 3 is a fragmentary sectional view taken in the direction of the arrows along the section line 3—3 of FIG. 2.

As is clear from the above summary of the invention and description of drawings, the present invention can be utilized to take advantage of void spaces in not only bathroom vanities, but in kitchen cabinets, housings, sinks and the like, and other types of cabinets housing receptacles mounted in the top therein, with equal success. In general, the vanity may be indicated by the numeral 11 as shown in FIG. 1. The vanity designated by the numeral 11 has a base 12 with left and right side walls 13 and 14, respectively, having inner and outer surfaces. A vanity top 15 having a sink formed therein 16 supplied with water by a faucet 17 may be provided. It is to be understood that the sink 16 can be formed in the top 15, or be of separate construction.

Figure 4:
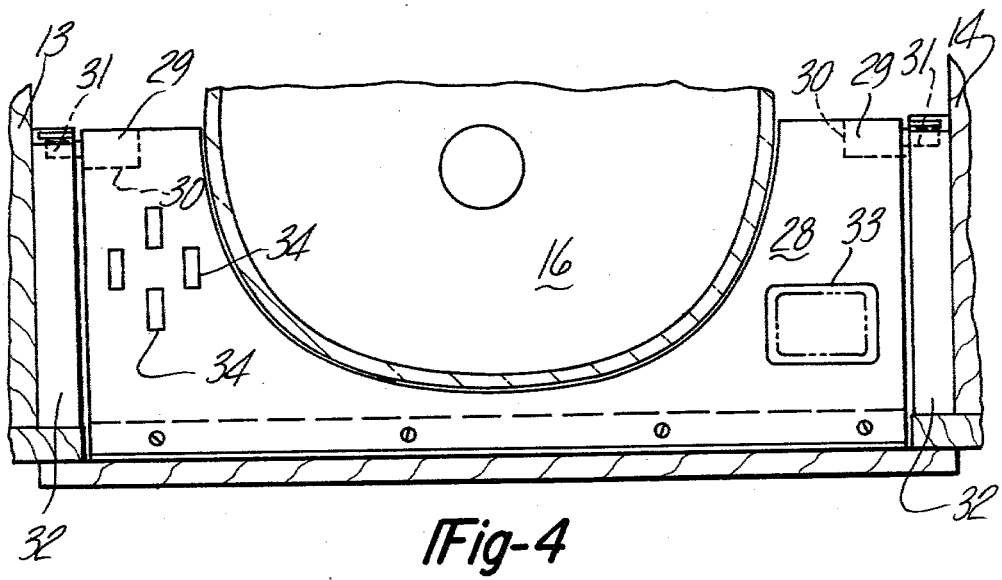
FIG. 4 is a fragmentary sectional view taken in the direction of the arrows on the section line 4—4 of FIG. 3.
Figure 7:
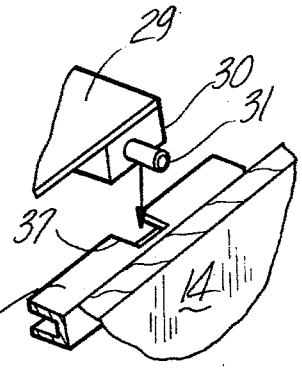
FIG. 7 is an exploded view showing how the pin provided on the rear portion of the shelf fits into the slot in the bracket assembly mounted to the inner side wall of the vanity.

The vanity also has a front wall 18 generally having one or more doors 19 hingedly attached thereto, and a front panel 20 which, previous to the present invention, was fixedly mounted in place by any suitable means. However, this is not the case any longer, as by referring to FIG. 2 it can be seen that the front wall 18 of the vanity now has the front panel 20 hingedly mounted thereto by means of a piano type or other hinge 21. A second hinge 25 is attached to the top of the front panel 20 and to a mounting block 26 having a recess in the top surface thereof to which is secured by any suitable means the front portion 27 of the shelf, generally designated by the numeral 28. To the rear portion of the shelf 29, there is mounted a rear mounting block 30. As best shown in FIGS. 4 and 7, the rear mounting block 30 is provided with a pin 31. Each of the pins 31 is adapted to fit interiorly of laterally extending C-shaped channels 32 which are mounted to the inner surfaces of the left and right side walls 13 and 14, respectively.

Figure 2:
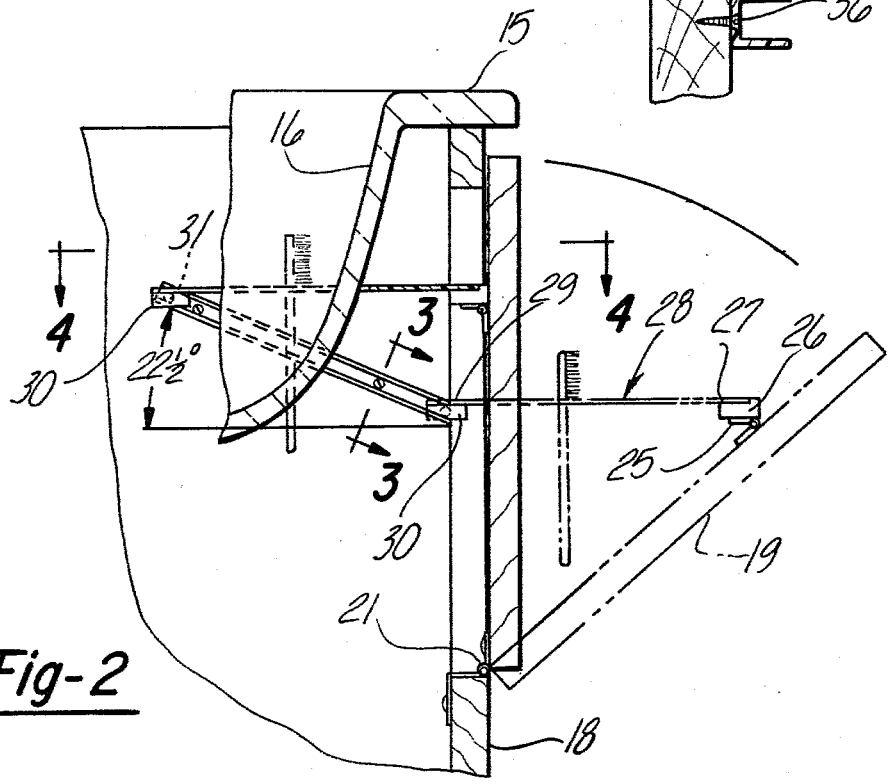
FIG. 2 is a sectional view taken in the direction of the arrows along the section line 2—2 of FIG. 1.

By choosing the dimensions of the vanity, and thus the spaces between the side walls 13 and 14, the shelf 28, the channel 32 and the pins 31 correctly, a free fit situation is provided. The choosing of such dimensions is well within the skill of the art, and need not be described herein in detail. As shown in FIG. 2, the side rails should be mounted on the interior portions of the side walls 13 and 14 at an angle substantially equal to $22\frac{1}{2}°$ to provide that the shelf 28 will remain in a horizontal plane while the front panel 20 is pulled down. It is, of course, understood that for various manufacturing reasons and the like, it may not be possible to mount these rails at exactly this angle, and it is well within the scope of the present invention to have the angle anywhere near $22\frac{1}{2}°$ which will maintain the shelf 28 in near enough to a horizontal position to prevent objects set thereon from sliding when the shelf is pulled out.

Referring now to FIG. 4, there is shown a substantially plan view of a construction embodying my invention, and it should be noted that the shelf area need not be entirely flat, but can be provided with a depression such as that indicated by the numeral 33, which serves as a soap dish, or can be perforated by openings, such as those shown at 34, which can be used as a toothbrush holder.

Figure 5:
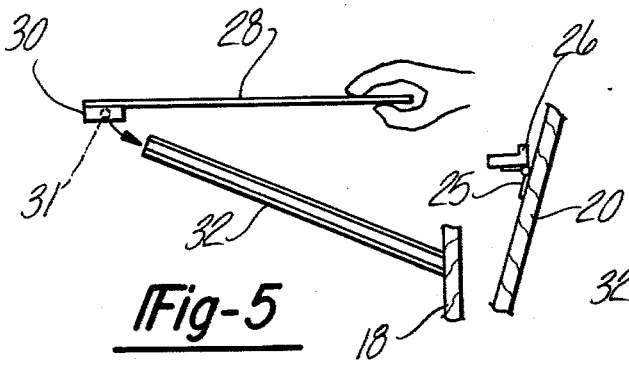
FIG. 5 is a simplified exploded view showing the method of assembly of a shelf and bracket construction embodying my invention.

The method of assembly of the present invention is shown in FIGS. 3 and 5–7 and varies depending on whether or not the channels 32 have a slot 37 therein. As shown in FIG. 5, if the channel 32 does not have a slot 37 therein the shelf 28 must first be inserted in the channel 32 by placing the pin 31 therein and then the shelf 28 must be attached to the recess mounting block 26 which has previously been mounted by means of the hinge 25 to the front panel 20.

Figure 6:
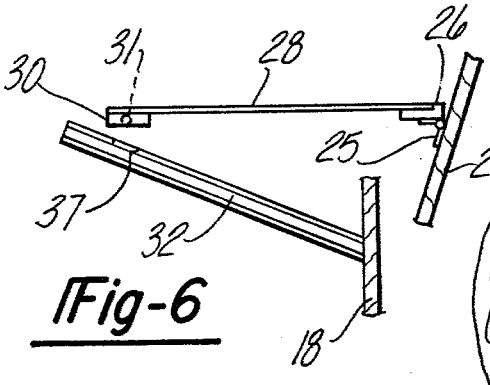
FIG. 6 is an exploded view similar to that shown in FIG. 5, but showing a different method of assembly for use when a slot is provided in the side wall bracket assembly.

However, as shown in FIGS. 6 and 7, this method may be reversed if the slot 37 is provided. The front panel 20 may be mounted to the front wall 18 in the manner previously described, the second hinge 25 may be attached to the inside of the front panel 20 and the recess mounting block 26 attached thereto. The shelf 28 may then be attached to the recess mounting block 26 before the pins 31 are inserted in the slot 37.

Figure 8:
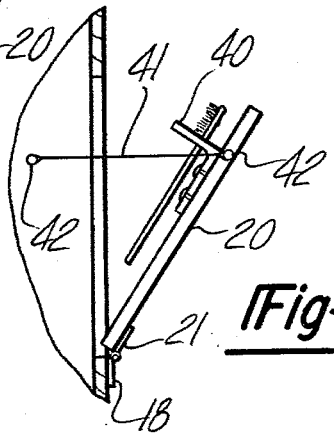
FIG. 8 shows a modification of the present invention for providing a method and apparatus for utilizing void spaces in vanities and the like which is suitable when the stationary shelf is not needed and only items such as toothbrushes, etc., need to be stored.

An alternate embodiment of my invention is shown in FIG. 8 for use where a large shelf such as that shown by the numeral 28 is not needed. In this embodiment, the front panel 20 is still hingedly mounted by the piano hinge 21 to the vanity front 18, and the shelf 28 is replaced by the right-angle contoured shelf 40 which has perforations in it suitable for holding toothbrushes. A wire chain, cable, or the like 41 is fastened in place by suitable fastening means, such as the screws 42.

Figure 9:
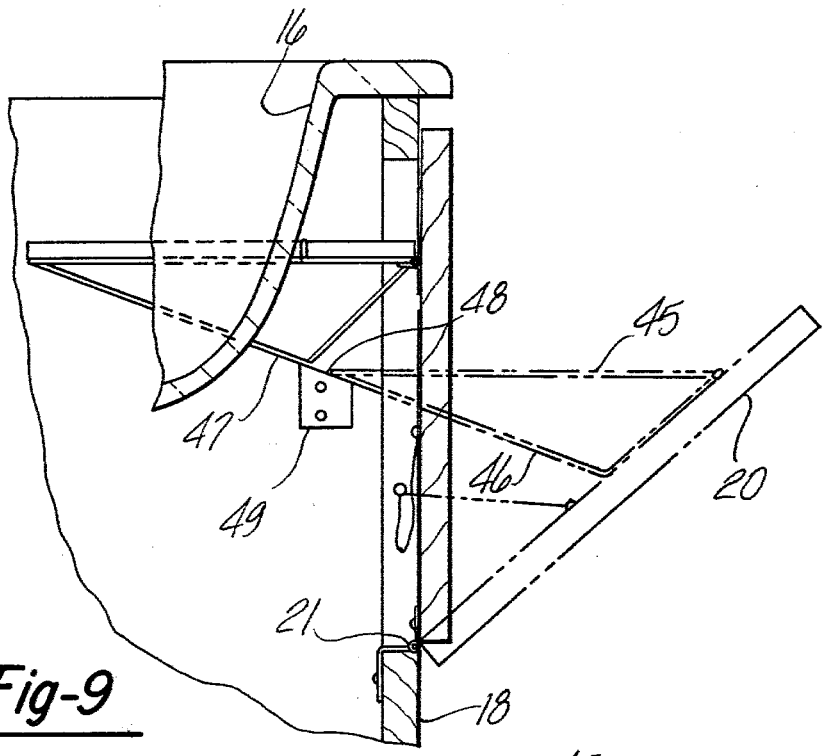
FIG. 9 is a sectional view similar to that shown in FIG. 2, but showing a modification of my invention wherein the shelf is hinged at the front and has a lower ramp portion having an angle of $22\frac{1}{2}°$ to the horizontal plane of the top of the shelf.
Figure 10:
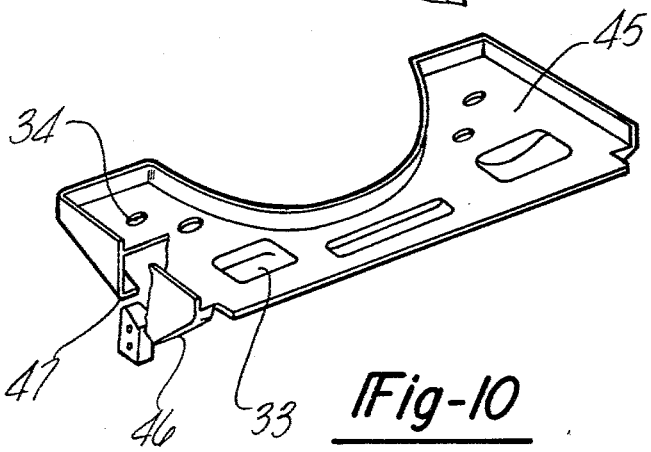
FIG. 10 is a perspective view of the modified shelf shown in FIG. 9.

Another embodiment of my invention can be seen by referring to FIGS. 9 and 10. These figures show the sink 16 placed in the vanity 11 and having, as before, a hingedly mounted front panel 20 held to the front wall 18 by means of the piano hinge 21. However, in this embodiment, the channel and pin assembly is eliminated and is replaced by a shelf 45 having a pair of downwardly projecting extensions 46 at the sides thereof. Each of the projections has a ramp portion 47 formed therein adapted to rub on the top surface 48 of a complimentary pair of rubbing blocks 49. As before, the shelf may have openings such as those illustrated by the numeral 34, or depressions therein, as illustrated by the numeral 33.

Thus, by providing a unique movable shelf apparatus which maintains a shelf in a horizontal position while it is moved forwardly, outwardly and downwardly, the objects of the present invention listed above and numerous additional advantages are obtained.

I claim:

1. In combination, in a cabinet having side walls and a front wall having a normally fixed front panel, an apparatus for utilizing void spaces in cabinets and the like, including a front panel hingedly mounted to said front wall in place of said normally fixed front panel, a second hinge fixedly mounted near the top of said hingedly mounted front panel, a mounting block fixedly mounted to said second hinge, a shelf having a front portion and a rear portion with said front portion fixedly mounted to said mounting block and said rear portion having mounted thereon a pair of rear mounting blocks each having a pin extending laterally therefrom, a pair of C-shaped channels mounted in a 180° opposed relationship, one each to the inner surfaces of said side walls at an angle of approximately $22\frac{1}{2}°$ from the horizontal, and adapted to receive said pins to allow said shelf to move downwardly and outwardly while maintaining a usable horizontal position when said hingedly mounted front panel is opened.

2. The device defined in claim 1, wherein each of said channels has a slot provided therein at a position opposite said second hinge when said hingedly mounted front panel is in its closed position, with the channel itself extending past said position.

3. The device defined in claim 1, wherein the rear portion of said shelf extends past the front of a sink or the like and has a cutout therein complimentary in shape to said sink.

4. The device defined in claim 3, wherein said shelf has at least one depressed portion therein suitable for holding soap or other articles.

5. The device defined in claim 3, wherein said shelf has perforations therein suitable for holding a toothbrush or the like.

6. The device defined in claim 3, wherein said rear mounting block consists of two separate mounting blocks mounted one on each side of said rear portion.

7. The device defined in claim 5, wherein said C-shaped channels are mounted to said side walls by suitable fastening means, such as screws and the like.

8. The device defined in claim 7, wherein said hinges are piano hinges.

9. The device defined in claim 8, wherein said cabinet has a base portion at the bottom thereof.

10. The device defined in claim 9, wherein said top of said cabinet and said sink are of integral one-piece construction.

11. The device defined in claim 9, wherein said sink and said top of said cabinet are of a separate construction, and said sink is securely mounted to said top.

12. A method for utilizing void spaces in cabinets and the like, including the step of providing in a cabinet having side walls, a front wall, and a normally fixed front panel, a hingedly mounted front panel in place of said formerly fixed panel, providing a mounting block, providing means to hingedly mount said mounting block to the inside of said front panel, providing a shelf having a front portion and a rear portion, fixedly mounting a rear mounting block having pins extending laterally thereof to the bottom of the rear portion of said shelf, providing a pair of C-shaped channels mounted in 180° opposed relationship to the side walls of said cabinet, placing said channels at an angle of 22½°, placing said pins in said channels, and securing the front portion of said shelf to said mounting block thereby providing a shelf which can move downwardly and outwardly while maintaining a usable horizontal position.

13. A method for utilizing void spaces in cabinets and the like, including the step of providing a front panel adapted to be hingedly mounted to said front wall of said cabinet, providing a second hinge fixedly mounted to the inside of said front panel, fixedly mounting a mounting block to one leaf of said hinge, fixedly mounting a shelf at its forward portion to said recessed mounting block, mounting a rear mounting block to the bottom of the rear portion of said shelf, providing a pair of C-shaped channels mounted in 180° opposed relationship to one each of the side walls of said cabinet, placing said pins in said channel and fixedly mounting said front panel by means of said hinge to said front wall of said vanity, thereby providing a shelf adapted to remain substantially horizontal throughout the entire travel of said pins in said channel resulting in a downward and outward movement of said shelf.

14. In combination, in a cabinet having side walls and a front wall having a normally fixed front panel, an apparatus for utilizing void spaces in cabinets and the like, including a front panel hingedly mounted to said front wall in place of said normally fixed front panel, a second hinge fixedly mounted near the top of said hingedly mounted front panel, a shelf fixedly mounted to said hinge, a pair of downwardly extending projections formed at either side of said shelf, each of said projections having a ramp portion formed thereon, and a pair of rubbing blocks having a top surface complimentary in shape to said ramp portions of said projections and adapted to receive the same thereby providing a shelf which will move downwardly and outwardly while maintaining a usable horizontal position.

15. The device defined in claim 14, wherein said shelf has at least one depressed portion therein suitable for holding soap or other articles.

16. The device defined in claim 15, wherein said shelf has perforations therein suitable for holding a toothbrush or the like.

17. The device defined in claim 14, wherein the top surface of said rubbing block is at an angle of 22½° from the horizontal.

* * * * *